US006655148B2

(12) United States Patent
Calvez et al.

(10) Patent No.: US 6,655,148 B2
(45) Date of Patent: Dec. 2, 2003

(54) FIXING METAL CAPS ONTO WALLS OF A CMC COMBUSTION CHAMBER IN A TURBOMACHINE

(75) Inventors: Gwénaëlle Calvez, Melun (FR); Didier Hernandez, Quiers (FR)

(73) Assignee: Snecma Moteurs, Paris (FR)

( * ) Notice: Subject to any disclaimer, the term of this patent is extended or adjusted under 35 U.S.C. 154(b) by 2 days.

(21) Appl. No.: 10/160,729

(22) Filed: Jun. 5, 2002

(65) Prior Publication Data

US 2002/0184886 A1 Dec. 12, 2002

(30) Foreign Application Priority Data

Jun. 6, 2001 (FR) ..... 01 07374

(51) Int. Cl.[7] ..... F02C 7/20
(52) U.S. Cl. ..... 60/753; 60/800
(58) Field of Search ..... 60/753, 752, 800, 60/804, 758

(56) References Cited

U.S. PATENT DOCUMENTS 5,291,732 A 3/1994 Halila
6,397,603 B1 * 6/2002 Edmondson et al. ..... 60/753

FOREIGN PATENT DOCUMENTS

EP 1 152 191 11/2001

* cited by examiner

*Primary Examiner*—Ehud Gartenberg
(74) *Attorney, Agent, or Firm*—Oblon, Spivak, McClelland, Maier & Neustadt, P.C.

(57) ABSTRACT

An annular combustion chamber has outer and inner axially-extending side walls of composite material and an end wall of metal material held in position on the outer and inner side walls by fixing means. Provision is made for the fixing means to pass through annular cavities that are designed to receive cylindrical end portions of the outer and inner side walls, and that are created between peripheral edges of the end wall and facing portions folded downstream, a determined amount of clearance J being provided between the peripheral edges and the facing faces of the outer and inner side walls in such a manner as to allow expansion to take place freely, in operation, in a radial direction between said end wall and said side walls.

10 Claims, 2 Drawing Sheets

FIXING METAL CAPS ONTO WALLS OF A CMC COMBUSTION CHAMBER IN A TURBOMACHINE

FIELD OF THE INVENTION

The present invention relates to the specific field of turbomachines and it relates more particularly to the problem posed by assembling a metal end-wall of a combustion chamber in a turbomachine to the side walls of said chamber, when said side walls are made of a composite material of the ceramic matrix composite (CMC) type.

PRIOR ART

Conventionally, in a turbojet or a turboprop, the high pressure turbine, in particular its inlet nozzle (HPT nozzle), the injection system, the combustion chamber, and the casing (also called the shell) of said chamber are all made out of metal materials. However under certain particular conditions of use implementing particularly high combustion temperatures, a chamber made entirely of metal turns out to be completely unsuitable from a thermal point of view and it is necessary to make use of a chamber that is based on high temperature composite materials of the CMC type. However, since those materials are very costly and are unable to withstand strong mechanical stresses, they are generally restricted to being used for the composite chamber itself and more particularly to its axially-extending side walls only, with the high pressure turbine inlet nozzle, the injection system, and the casing then still being made more conventionally out of metal materials. Unfortunately, metals and composites have coefficients of thermal expansion that are very different. This gives rise to particularly awkward problems, specifically with connecting together the composite material side walls and the metal end-wall of the combustion chamber.

OBJECT AND BRIEF SUMMARY OF THE INVENTION

The present invention mitigates those drawbacks by proposing a mounting for the metal end-wall with the ability to accommodate the displacements induced by the different coefficients of expansion of the metal end-wall and of the composite side walls of the combustion chamber. An object of the invention is thus to provide a mounting that has good dynamic behavior and good sealing.

These objects are achieved by an annular combustion chamber including outer and inner axially-extending side walls of composite material and an end wall of metal material, said end wall being held in position on said outer and inner side walls by fixing means, wherein said fixing means pass through annular cavities that are designed to receive cylindrical end portions of said outer and inner side walls, and that are created between peripheral edges of said end wall and facing portions folded downstream, a determined amount of clearance J being provided between said peripheral edges and the facing faces of said outer and inner side walls in such a manner as to allow expansion to take place freely, in operation, in a radial direction between said end wall and said side walls.

With this system of fixing merely by means of bolts and sliding mounts, the expansion of the metal end-wall is accommodated without deteriorating the composite material walls.

The fixing means are constituted by a plurality of bolts, preferably captive-nut bolts.

The outer and inner side walls are advantageously provided with a plurality of holes designed to co-operate with said fixing means once said fixing means are mounted on said end wall.

In a preferred embodiment, the end wall can further comprise means to ensure sealing between said end wall and said side walls. The sealing means include a "spring blade" type circular gasket mounted in a circular groove of said metal end-wall and designed to bear on said facing side wall of the facing combustion chamber. In its downstream portion, said "spring blade" circular gasket preferably includes a rim designed to bear in toroidal manner on said facing side wall of the combustion chamber. Said circular sealing gasket should be divided into sectors, and held against said side wall by means of a resilient element fixed on said metal end-wall. The resilient element is constituted by a blade spring.

In an advantageous embodiment, the end wall can also integrate inner and outer caps of metal material which extend its peripheral edges upstream and provide better control over dynamic behavior.

BRIEF DESCRIPTION OF THE DRAWINGS

The characteristics and advantages of the present invention appear better from the following description made by way of non-limiting indication and with reference to the accompanying drawings, in which.

DETAILED DESCRIPTION OF A PREFERRED EMBODIMENT

Figure 1:
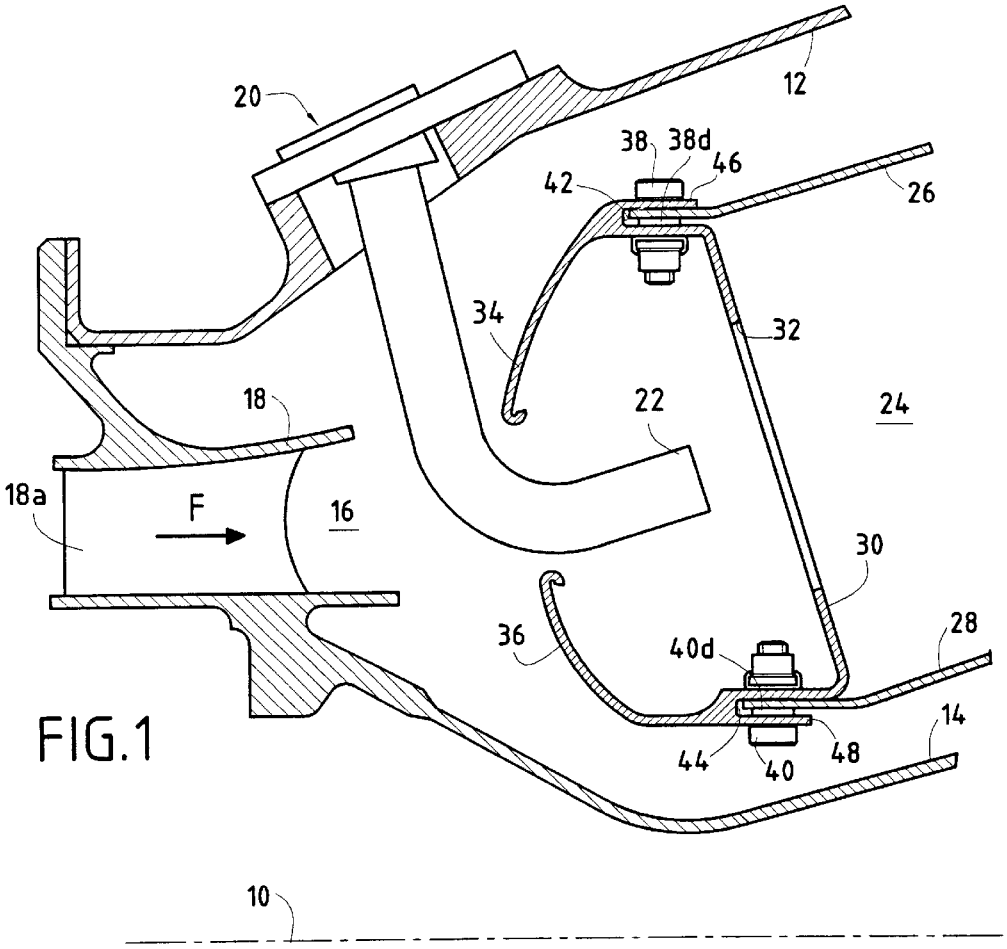
FIG. 1 is a diagrammatic axial half-section of an injection portion of a turbomachine incorporating a first embodiment of an assembly of the invention.
Figure 2:
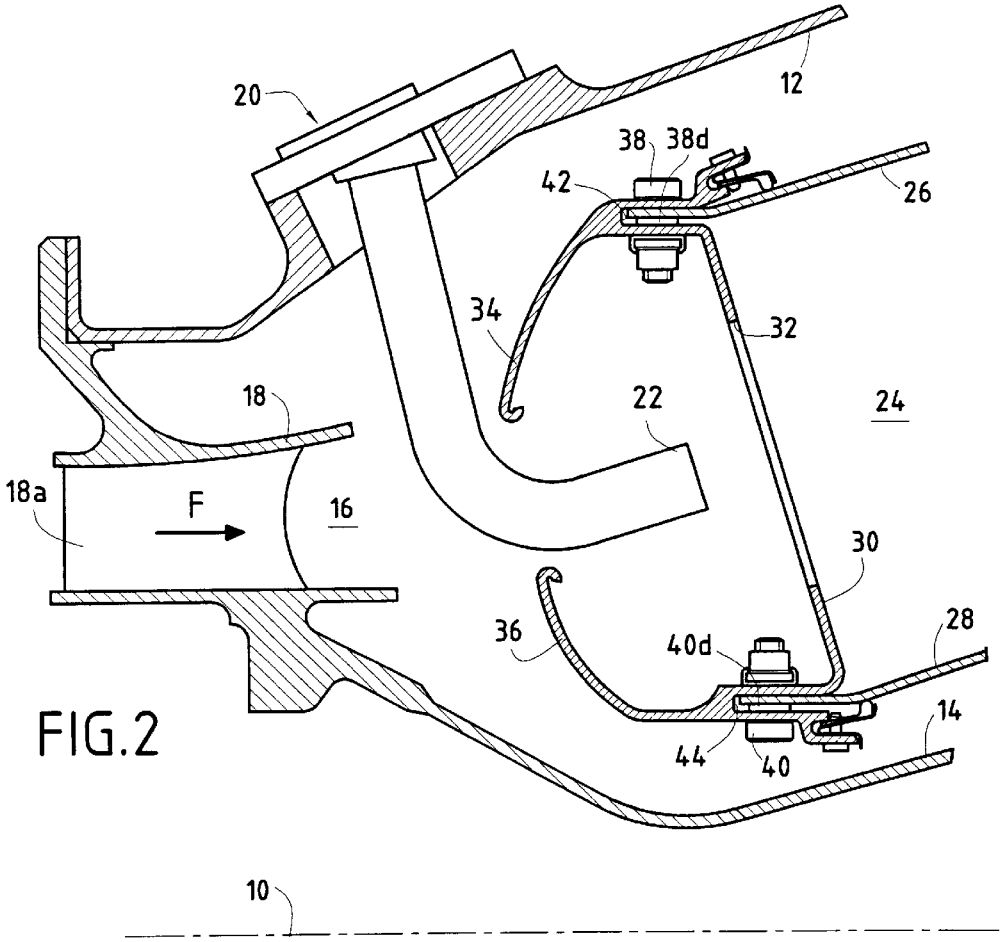
FIG. 2 is a diagrammatic axial half-section of an injection portion of a turbomachine incorporating a second embodiment of an assembly of the invention.

FIGS. 1 and 2 are axial half-section views of an injection portion of a turbomachine comprising:

- an outer annular shell (or outer casing) 12 having a longitudinal axis 10;
- an inner annular shell (or inner casing) 14 that is coaxial therewith; and
- an annular space 16 extending between the two shells 12 and 14 for receiving compressed oxidizer, generally air, coming from an upstream compressor (not shown) of the turbomachine via an annular diffuser duct 18 (having a diffuser screen 18*a*) defining a general flow F of gas.

In the gas flow direction, this space 16 comprises firstly an injection assembly formed by a plurality of injection systems 20 that are regularly distributed around the duct 18, each comprising a fuel injection nozzle 22 fixed to the outer annular shell 12 (in order to simplify the drawings, the mixer and the deflector associated with each injection nozzle are omitted), followed by an annular combustion chamber 24 formed by an outer axially-extending side wall 26 and an inner axially-extending side wall 28, both disposed coaxially about the axis 10 and made of a high temperature composite material of the CMC type or of some other type (e.g. carbon), and a transversely-extending end wall 30 made of a metal material forming the end wall of the combustion chamber, and provided with openings 32 in which a portion of the injection system is fixed, and finally an annular nozzle (not shown) forming an inlet stage of a high pressure turbine.

In the two embodiments shown, the outer fairing (or cap) 34 extending the outer wall 26 of the combustion chamber upstream (relative to the flow F), and the inner fairing (or cap) 36 extending the inner wall 28 of the combustion chamber upstream (relative to the flow F) are directly integrated into the end wall 30, and like said end wall, are thus made of metal material (further simplifying the general shape of the upstream ends of the combustion chamber which can thus be constituted by simple cylindrical portions). Naturally, a configuration with a fairing (a single one-piece cap of toroidal shape) interconnecting the two upstream ends of the side walls of the combustion chamber (and thus provided with openings through which the injection nozzles 22 can pass) can also be envisaged.

According to the invention, the metal annular end-wall 30 of the combustion chamber which has a coefficient of thermal expansion that is very different from that of the composite-material outer and inner side walls 26, 28 of the combustion chamber is held in position on the upstream cylindrical ends of the side walls by a plurality of fixing means 38, 40 regularly distributed around the longitudinal axis 10. The fixing means pass through annular cavities 42, 44 designed to receive the cylindrical end portions of the side walls, and created between peripheral ends of the end wall 30 and facing folded portions 46, 48 extending the caps 34, 36 downstream.

Figure 1A:
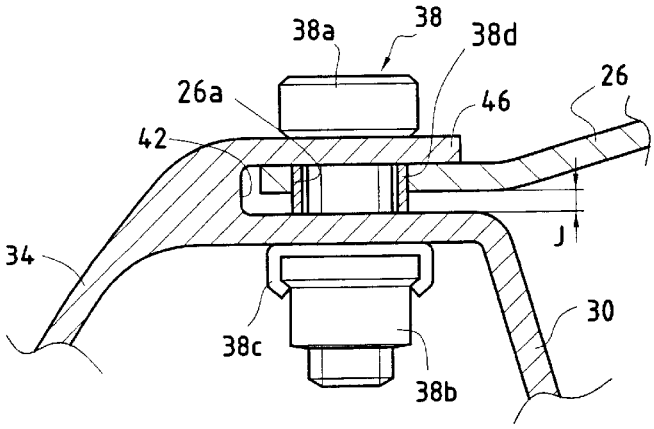
FIG. 1*a* shows a detail of the assembly of FIG. 1.

In a first embodiment, shown in general manner in FIG. 1 and in more detail in FIG. 1A, the fixing means 38, 40 are formed by a plurality of metal bolts of the captive nut type, i.e. each including a screw 38*a*, a nut 38*b*, and a holding cage 38*c* fixed on the end wall 30 (advantageously by spot welding) and preventing the nut from rotating. With bolts of this type, tightening (during assembly) is obtained directly, merely by turning the screw without any need to use a special tool (e.g. pliers) to prevent the nut from rotating, said prevention of the nut from rotating being achieved very simply, merely by the cage. In addition, disassembly can also be performed very simply, in the opposite manner, merely by loosening the screw.

The amount of clearance J between the inner faces of the outer and inner side walls 26, 28 and the facing peripheral edges of the end wall 30 is calculated in such a manner as to allow expansion to take place freely, in operation, between the metal cap and the composite material side walls. The clearance enables expansion of the end wall to be accommodated without deteriorating the composite material side walls which are displaced very little in a radial direction. The dual centering system comprising the outer and the inner walls 26, 28 received in the corresponding cavities 42, 44 ensures relative sealing of the end wall while also providing axial retention both during assembly (when cold) and in flight at cruising speed (when hot).

To facilitate assembly of the end wall on the side walls, said side walls are provided with holes 26*a*, 28*b* designed to receive bushings 38*d*, 40*d* through which the screw shafts of the fixing means 38, 40 previously mounted on the end wall pass, the permanent contact of the screws with the cap 34, 36 limiting the risks of clamping torque becoming lost during said assembly. The bushings on which the side walls 26, 28 slide during expansion of the end wall 30 further enhance centering and support of said side walls.

Figure 2A:
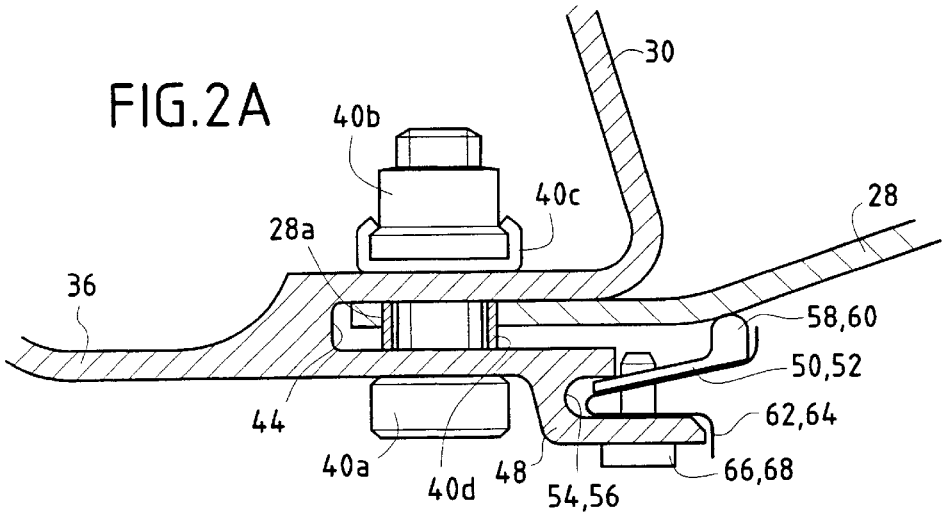
FIG. 2*a* shows a detail of the assembly of FIG. 2.

FIG. 2 shows, in general manner, a second embodiment which is shown in detail in FIG. 2*a*, and in which a "spring blade" type circular gasket 50, 52 is mounted in a circular groove 54, 56 formed at the downstream end of the folded portion 46, 48 of the outer or inner cap 36 in order to guarantee better sealing between the outer or inner side wall 26, 28 and the end wall 30. In its downstream portion, the sealing gasket includes a rim 58, 60 designed to bear in toroidal manner on the facing side wall 26, 28 of the combustion chamber. The gasket is pressed against the wall by a resilient element 62, 64, preferably a blade spring, and held in position by a plurality of pegs 66, 68 secured to the downstream end of the cap.

As above, it is observed that the clearance existing between the peripheral edges of the end wall and the inner faces of the side walls is determined so as to allow expansion of the end wall to be accommodated without deteriorating the composite material side walls.

The gasket ensuring sealing with the outer side wall is prestressed when cold, and the gasket ensuring sealing with the inner wall is merely put into contact. When hot, the opposite applies as a result of the expansion differences between the metal end-wall and the inner and outer walls.

What is claimed is:

1. An annular combustion chamber including outer and inner axially-extending side walls of composite material and an end wall of metal material, said end wall being held in position on said outer and inner side walls by fixing means, wherein said fixing means pass through annular cavities that are designed to receive cylindrical end portions of said outer and inner side walls, and that are created between peripheral edges of said end wall and facing portions folded downstream, a determined amount of clearance J being provided between said peripheral edges and the facing faces of said outer and inner side walls in such a manner as to allow expansion to take place freely, in operation, in a radial direction between said end wall and said side walls.

2. A combustion chamber according to claim 1, wherein said fixing means are constituted by a plurality of bolts, preferably captive-nut bolts.

3. A combustion chamber according to claim 1, wherein said outer and inner side walls are provided with a plurality of holes designed to co-operate with said fixing means once said fixing means are mounted on said end wall.

4. A combustion chamber according to claim 1, wherein said end wall further comprises means to ensure sealing between said end wall and said side walls.

5. A combustion chamber according to claim 4, wherein said sealing means include a "spring blade" type circular gasket mounted in a circular groove of said metal end-wall and designed to bear on said facing side wall of the facing combustion chamber.

6. A combustion chamber according to claim 5, wherein, in its downstream portion, said "spring blade" circular gasket includes a rim designed to bear in toroidal manner on said facing side wall of the combustion chamber.

7. A combustion chamber according to claim 5, wherein said circular sealing gasket is divided into sectors.

8. A combustion chamber according to claim 5, wherein said circular sealing gasket is held against said side wall by means of a resilient element fixed on said metal end-wall.

9. A combustion chamber according to claim 8, wherein said resilient element is constituted by a blade spring.

10. A combustion chamber according to claim 1, wherein said end wall integrates inner and outer caps of metal material which extend its peripheral edges upstream.

* * * * *